United States Patent [19]

Ackermann et al.

[11] Patent Number: 4,839,482

[45] Date of Patent: Jun. 13, 1989

[54] GAS-BLAST BREAKER

[75] Inventors: Ulrich Ackermann, Turgi; Kurt Faller, Brugg; Krzysztof Guzek, Thalwil; Arnold Meier, Wettingen, all of Switzerland

[73] Assignee: BBC Brown Boveri AG, Baden, Switzerland

[21] Appl. No.: 173,547

[22] Filed: Mar. 25, 1988

[30] Foreign Application Priority Data

Mar. 25, 1987 [CH] Switzerland ..... 01139/87

[51] Int. Cl.[4] ..... H01H 33/70

[52] U.S. Cl. ..... 200/148 B; 200/148 R

[58] Field of Search ..... 200/148 B, 148 R

[56] References Cited

U.S. PATENT DOCUMENTS 4,748,305 5/1988 Luginbuhl ..... 200/148 B

*Primary Examiner*—Robert S. Macon

*Attorney, Agent, or Firm*—Burns, Doane, Swecker & Mathis

[57] ABSTRACT

The gas-blast breaker exhibits two contact members (1, 2) which are located in a housing filled with insulating gas and can be brought into and out of engagement with one another along an axis (5), and an insulating material nozzle (4) through the nozzle constriction (6) of which an arc burns during a switching process. The nozzle constriction (6) is formed by several segments (7) which follow one another in the circumferential direction, can be moved in the radial direction and can be loaded with a centripetally acting force.

In this gas-blast breaker, the cross-section of the nozzle constriction (6) which is effective during a switching process is intended to be largely independent of the number of switching processes performed and causing nozzle erosion.

This is achieved by the fact that the segments (7) exhibit in each case at least two side faces (16, 17, 18, 19, 20, 21) which are parallel to one another and to the axis (5) and which are delimited in each case by an edge extending in the surface of the nozzle constriction (6), and that adjacent segments (7) are supported on one another with their edges delimiting the side faces (19, 20) of these segments which are opposite to one another.

9 Claims, No Drawings

GAS-BLAST BREAKER

BACKGROUND OF THE INVENTION

1. Field of the Invention

The invention is based on a gas-blast breaker according to the first part of claim 1.

2. Discussion of Background

The invention relates to a prior art of gas-blast breakers as is described, for example, in DE-A1-3321 740. The known breaker exhibits two contact members arranged in an insulating gas-filled housing and an insulating material nozzle of several segments arranged successively in the circumferential direction. The segments are loaded via springs with a force acting centripetally. As a result, one of the two contact members can be guided through the insulating material nozzle in the closed position of the breaker and, when opening, the diameter of the constriction of the insulating material nozzle is considerably reduced compared with the diameter determined by the contact member guided through in the closed position. Such a breaker is characterized by good related-current carrying capacity with good quenching capability and without using additional rated-current contacts. However, when large short-circuit currents are interrupted, the insulating material nozzle is subjected to great erosion which considerably increases the diameter of the nozzle constriction and makes it considerably more difficult to build up sufficient quenching gas pressure. In addition, the contact member guided through the nozzle constriction collides undamped and at high speed with the segments of the insulating material nozzle in an O-C-O switching cycle and causes unwanted mechanical stresses during this process.

SUMMARY OF THE INVENTION

The invention as specified in claim 1 achieves the object of specifying a gas-blast breaker in which the cross-section of the insulating material nozzle effective during a switching process is largely independent of the number of switching processes carried out. The gas-blast breaker according to the invention is characterized by the feature that, compared with a comparable gas-blast breaker without correspondingly constructed insulating material nozzle, it is less susceptible to having to be inspected since the effective cross-section of the insulating material nozzle remains constant even after several switching processes, and consequently the pressure build-up of the breaker, which depends on this cross-section and determines the quenching capability, does not change. There are no unwanted mechanical stresses of the insulating material nozzle and of the contact member guided through the insulating material nozzle. In addition, the gas pressure of the (quenching gas serving) to blast the switching arc burning between the contact members during a switching process can be considerably increased by selecting as material for the insulating material nozzle materials which evaporate at a comparatively high rate. This makes it possible largely to dispense with additional blasting aids which may act pneumatically or magnetically.

BRIEF DESCRIPTION OF THE DRAWINGS

In the text which follows, the invention is explained in greater detail with reference to illustrative embodiments shown in the drawing, in which: FIG. 1 shows a top view of an axial section through a first illustrative embodiment of the gas-blast breaker according to the invention, in which the state of the breaker for the execution of switching processes is shown in the right-hand half of the figure and the state after large short-circuit currents have been interrupted several times is shown in the left-hand half, FIG. 2 shows a top view of a section through the gas-blast breaker according to FIG. 1 along II—II, FIG. 3 shows a top view of an axial section through a second illustrative embodiment of the gas-blast switch according to the invention, in which the state of the breaker before execution of switching processes is shown in the right-hand half of the figure and the state after large short-circuit currents have been interrupted several times is shown in the left-hand half, FIG. 4 shows a top view of a section through the gas-blast breaker according to FIG. 3 along IV—IV, and FIG. 5 shows a top view of an axial section through a third illustrative embodiment of the gas-blast breaker according to the invention.

DESCRIPTION OF THE PREFERRED EMBODIMENTS

Parts having the same effect are provided with identical reference symbols in all figures. In the gas-blast breaker shown in FIGS. 1 and 2, two contact members 1 and 2 constructed as arcing contacts and an insulating material nozzle 4 held by a support body 3 are arranged in a housing, not shown, filled with insulating gas such as, for example, sulphur hexaflouride of some bar pressure. Contact members 1 and 2, support body 3 and insulating material nozzle 4 are essentially rotationally symmetrically constructed and are arranged coaxially with respect to an axis 5. The insulating material nozzle 4 exhibits a nozzle constriction 6 which is formed by 8 segments 7 following one another in the circumferential direction. The support body 3 and the insulating material nozzle 4 surround, at a distance from it, the contact member 2 which is shown to be hollow cylindrical but can also be constructed, if necessary, as solidly cylindrical. The support body 3 is constructed at its end carrying the insulating material nozzle 4 as an annular rated-current contact 8 and is rigidly connected in an electrically conductive manner to the contact member 2 via a part, not shown. It also encloses an annularly constructed volume 9. During the opening process, the volume 9 can be connected to the nozzle constriction 6 via a duct 10 which is annularly constructed and delimited by the part of the insulating material nozzle 4 located upstream of the nozzle constriction 6 and by the free end of the contact member 2. The contact member 1 which is shown to be solidly cylindrical but, if necessary, can also be constructed to be hollow cylindrical is rigidly connected in an electrically conductive manner to a rated-current contact, not shown, and, in the closing condition of the gas-blast breaker, is carried through the nozzle constriction 6 of the insulating material nozzle 4 into the free end of the contact member 2.

Apart from the segments 7 consisting of a relatively temperature-resistant insulating material such as, for example, polytetrafluoroethylene, the insulating material nozzle 4 also exhibits a two-part molded body also formed of relatively temperature-resistant insulating material. A first part 11 of this molded body is constructed to be hollow cylindrical and exhibits at its end facing away from the support body 3 radially conducted slots of rectangular cross-section, in which in each case one of the segments 7 is carried to be radially movable with respect to the axis 5. A second part 12 of the insulating material nozzle coaxially encloses the first part 11 and forms with its free end the part of the insulating material nozzle 4 located downstream of the constriction 6. Between the two parts 11 and 12, an annular gap is recessed in which a spring 13 and a ring 14 having an inside cone 15 are carried. The segments are supported with their outside surfaces facing away from the novel constriction 6 on the inside cone 15 and in each case exhibit two side faces, for example 16, 17; 18, 19; 20, 21; which are parallel to one another and to the axis 5 and which are delimited in each case by an edge, for example, 22, 23 extending in the surface of the nozzle constriction 6 (FIG. 1). The side faces, for example 16, 17, in each case rest against limiting areas of the slots extending parallel to one another. Adjacent segments 7 supporting one another are supported on one another with their edges delimiting side faces, for example 19, 20, which are opposite to one another (FIG. 2). The segments 7 are rotatably supported on their ends facing away from the free end of the insulating material nozzle 4 and are in each case subject to the action of a support spring 24 loading the segments 7 with a centrifugal force. Instead of support springs 24, for example, an O-ring can also be used for loading the segments 7 with a centrifugally acting force.

Such a gas-blast breaker then operates as follows: During the opening operation, the contact members 1 and 2 are guided into the position specified in FIG. 1. The contact members 1 and 2 which engage one another in the closed position, are separated during this process and accommodate the roots of a switching arc, not shown in the figure, burning through the nozzle constriction 6. Before interruptions are carried out, the gas-blast breaker is initially in the state specified in the right-hand halves of FIGS. 1 and 2, in which the segments 7 are still free of erosion and exhibit a predetermined maximum extent in the radial direction. In this condition, the segments 7 are loaded with a centripetally acting force. This force is caused by the ring 14 which is under the effect of the spring 13 under tension and the inside cone 15 of which, in the area of its largest diameter, guides the segments 7 towards the inside in such a manner that they are supported against one another with their edges for example 22, 23 located in the surface of the nozzle constriction 6 - as can be seen from the right-hand half of FIG. 2.

When a high short-circuit current is switched, the switching arc, which has its roots between the contact members 1, 2, erodes material from the nozzle constriction 6. Under the action of the spring-loaded ring 14, the segments 7 supported to be capable of sliding on the inside cone 15 are then guided along their parallel side faces, for example 16, 17 towards the inside until the edges, for example, 22, 23, of adjacent segments are again supported on one another. The result of this is that the diameter of the nozzle constriction 6 remains essentially constant even after large short-circuit currents have been switched several times, for example 10 times. This can be seen from the left-hand half of FIGS. 1 and 2. The constant diameter of the nozzle constriction 6 is of particular advantage for building up a gas pressure in the volume 9 which is sufficient for successfully blasting the switching arc 4. In addition, it is of advantage that the gas-blast breaker does not require an inspection even after large short-circuit currents have been switched several times, if the segments 7 are made of a material which emits quenching gas under the action of the arc.

The high gas pressure existing in the nozzle constriction 6 when large short-circuit currents are switched cannot press the individual segments 7 outwards with a suitable choice of the inclination of the inside cone 15, causing self locking. In this arrangement, the support springs 24 acting radially outward have the effect that the segments 7 are always loaded with a restoring force, as a result of which an accidental displacement of one of the segments 7, for example due to its inherent weight, is reliably prevented when the breaker is open.

In the gas-blast breaker shown in FIGS. 3 and 4, an annular disk-shaped recess 25 is provided in the insulating material nozzle 4, in which recess four segments 7 forming the nozzle constriction 6 are arranged. These segments exhibit in each case side walls 26, 27, 28 and 29 which extend section by section is parallel to one another and parallel to the axis 5 and which are delimited by edges 30 and 31 before switching processes are performed — as can be seen from the right-hand half of FIG. 4. The segments 7 in each case also exhibit front faces which extend transversely to the axis 5 and parallel to one another and which are slidably supported on annular front faces 32 and 33 of the recess 25. Two adjacent segments 7 each are displaceably guided in the radial direction by a rod 34 arranged in the circumferential direction. The rod 34 can be attached, for example, to a radially extending part of the side wall of one of the segments 7 and is then carried deeper into a hole, also arranged in the circumferential direction, in the opposite side wall of the adjacent segment during a radially inwardly directed displacement of the segments 7. The segments are in each case rigidly connected to a piston 36 via a rod 35. The piston 36 is carried in a cylindrical space 37 recessed in the insulating material nozzle 4. The part of the cylinder space 37 located above the piston 36 is connected via a duct 38 to the annular duct 10 and the volume 9, not shown. The part of the cylinder space 37 located below the piston 36 is connected via a duct 39 to an expansion space 40 provided downstream of the nozzle constriction 6 and intended for accomodating exhausted quenching gas.

In this breaker, the arc burning between the contact members 1 and 2 in the nozzle constriction 6 during the opening process builds up quenching gas with high gas pressure upstream of the nozzle constriction 6 which loads via the annular duct 10, possibly the volume 9, the ducts 38 and the cylinder space 37, the pistons 36 and thus the segments 7 with a radially inwardly directed force. During this process, the ducts 39 provided below the pistons 36 ensure that the low gas pressure of the quenching gas existing in the expansion space 40 is present in this area and thus the effect of the force of the pistons 36 can be fully developed. The areas of the pistons 36 are in each case dimensioned in such a manner that the force acting radially outward on the segments 7 in the area of the nozzle constriction 6 during the high-current phase is fully compensated and, as a result, no radially outwardly directed displacement of the segments 7 can occur.

In the embodiment of the gas-blast breaker according to the invention, shown in FIG. 5, the nozzle constriction 6 is also formed by eight segments in accordance with the embodiment of FIGS. 1 and 2, but these segments are arranged displaceably in an annular recess 25 of the insulating material nozzle 4 in accordance with the embodiments of FIGS. 3 and 4. In this breaker, the segments 7 are loaded with the centripetally acting force via the ring 14 provided with the inside cone 15. In this arrangement, the force is supplied by the switching arc in accordance with the embodiment of FIGS. 3 and 4. In contrast to the embodiment according to FIGS. 3 and 4, the high-pressure quenching gas supplied by the arc only acts via the annular duct 10 and the volume 9 on a ring piston 42 provided in an annular cylinder space 41 in the embodiment according to FIG. 5. This ring piston is rigidly connected to the ring 14 via rods 43. A duct 44 provided in the insulating material nozzle 4 ensures that the low gas pressure existing in the expansion space 40 is present on the side of the ring piston facing away from the high-pressure quenching gas, so that the piston 42 loaded with high-pressure quenching gas can load the segments 7 with a radially inwardly acting force via the rods 43 and the ring 14.

If the ring 14 exhibits a front face constructed as a piston and if it is carried in an annular duct which can be loaded with the high-pressure quenching gas generated by the switching arc, it is possible, with suitable dimensioning of the ring 14, to omit the piston cylinder arrangement formed by the cylinder space 41 and the piston 42. The duct 44 is then suitably arranged between the recess 25 and the expansion space 40.

What is claimed as new and desired to be secured by letters patent of the United States is:

1. Gas-blast breaker having an insulating-gas-filled housing, two contact members (1, 2) which are located in the housing and can be brought into or out of engagement with one another along an axis (5), between which an arc burns during a switching process, and having an insulating material nozzle (4), the nozzle constriction (6) of which, exposed to the action of the arc, is formed by several segments (7) which follow one another in the circumferential direction, can be moved in the radial direction and can be loaded with a centripetally acting force, wherein the segments (7) exhibit in each case at least two side faces (16, 17, 18, 19, 20, 21) which are parallel to one another and to the axis (5) and which are delimited in each case by an edge (22, 23) extending in the surface of the nozzle constriction (6) and that adjacent segments (7) are supported on one another with their edges delimiting the side faces (19, 20) of these segments (7) are opposite to one another.

2. Gas-blast breaker as claimed in claim 1, wherein the segments (7) are supported with their ends facing away from the nozzle constriction (6) on a ring (14) having an inside cone (15).

3. Gas-blast breaker as claimed in claim 2, wherein the ring (14) is under the action of a loaded spring (13).

4. Gas-blast breaker as claimed in claim 2, wherein the ring (14) is frictionally coupled to a pneumatic piston-cylinder arrangement which is driven by the pressure of the insulating gas generated by the arc.

5. Gas-blast breaker as claimed in claim 4, wherein the ring (14) exhibits a front face constructed as a piston and is guided in an annular duct which is charged with the pressure of the insulating gas generated by the arc.

6. Gas-blast breaker as claimed in claim 1, wherein the segments (7) are in each case frictionally coupled to a piston-cylinder arrangement which can be loaded in each case with the pressure of the insulating gas generated by the arc.

7. Gas-blast breaker as claimed in one of claims 1 to 6, wherein each of the segments (7) is in each case supported in a slot of a hollow-cylindrical molded body which exhibits in each case two limiting areas which are parallel to one another and which guide at least two side faces (16, 17, 18, 19, 20, 21) of the segment (7).

8. Gas-blast breaker as claimed in claim 7, wherein the segments (7) are loaded with a centrifugally acting force.

9. Gas-blast breaker as claimed in one of the claims 1 to 6, wherein two adjacent segments (7) each are guided by a rod (34) arranged in the circumferential direction.

* * * * *